US007517841B2

(12) United States Patent
Coleman et al.

(10) Patent No.: US 7,517,841 B2
(45) Date of Patent: Apr. 14, 2009

(54) CLEANSING RECEPTACLE

(76) Inventors: Estella L. Coleman, 153 E. Little Canada, #113, Little Canada, MN (US) 55117; Michael V. Coleman, 153 E. Little Canada, #113, Little Canada, MN (US) 55117

( * ) Notice: Subject to any disclaimer, the term of this patent is extended or adjusted under 35 U.S.C. 154(b) by 0 days.

(21) Appl. No.: 11/251,957

(22) Filed: Oct. 16, 2005

(65) Prior Publication Data

US 2007/0094823 A1 May 3, 2007

(51) Int. Cl.
*A47K 7/02* (2006.01)

(52) U.S. Cl. ..... 510/130; 134/6; 401/201; 15/227

(58) Field of Classification Search ..... 510/130; 134/6; 15/227; 401/201
See application file for complete search history.

(56) References Cited

U.S. PATENT DOCUMENTS

| | | | | | |
|---|---|---|---|---|---|
| 4,480,939 | A * | 11/1984 | Upton | 401/201 |
| 5,022,517 | A | 6/1991 | Benitez | 206/77.1 |
| 5,092,682 | A * | 3/1992 | Fenick | 383/22 |
| 5,207,725 | A | 5/1993 | Pinkerton | 383/24 |
| 5,462,378 | A | 10/1995 | Webb | 401/201 |
| 5,839,842 | A | 11/1998 | Wanat et al. | 401/201 |
| 5,915,434 | A * | 6/1999 | Juarez | 15/114 |
| 6,015,242 | A | 1/2000 | Gillis | 401/201 |
| 6,042,288 | A | 3/2000 | Rattinger et al. | 401/201 |
| 6,264,391 | B1 | 7/2001 | Kroha | 401/201 |
| 6,267,524 | B1 * | 7/2001 | Kroha | 401/201 |
| 6,644,881 | B1 | 11/2003 | Dawan | 401/201 |
| 6,694,563 | B2 | 2/2004 | Onwugbonu | 15/244.3 |
| 6,783,294 | B2 | 8/2004 | Duden et al. | 401/201 |
| 6,902,338 | B2 | 6/2005 | Puvvada et al. | 401/201 |
| 6,968,808 | B2 * | 11/2005 | Claire | 119/652 |
| 7,056,023 | B2 * | 6/2006 | Heidel | 383/117 |
| 2003/0198501 | A1 * | 10/2003 | Dawan | 401/201 |
| 2005/0072374 | A1 * | 4/2005 | Claire | 119/652 |
| 2005/0095056 | A1 | 5/2005 | King | 401/201 |
| 2005/0186016 | A1 | 8/2005 | O'Brie | 401/201 |
| 2007/0094823 | A1 * | 5/2007 | Coleman et al. | 15/159.1 |

* cited by examiner

*Primary Examiner*—Mark Eashoo
*Assistant Examiner*—Mohammad Reza Asdjodi
(74) *Attorney, Agent, or Firm*—Fredrikson & Byron, P.A.

(57) ABSTRACT

Embodiments of the invention relate to providing a cleansing article. The cleansing article generally includes one or more of a receptacle, a container, one or more segments, a material piece, and one or more of a solid cleanser and a liquid cleanser. The receptacle, the container, the one or more segments, and the material piece are each generally formed of an open cell material. In certain embodiments, the receptacle is used with the one or more segments to increase the activating area of the receptacle. As such, more soapy lather can be created via the one or more solid cleanser and liquid cleanser in comparison to solely using the receptacle. In certain embodiments, the one or more segments are held within the receptacle via the container or via the material piece. As such, the segments being held in such fashion collectively serve as a temporary reservoir for soapy lather created. However, since the receptacle, the container, the one or more segments, and the material piece are each generally formed of an open cell material, the cleansing article enables a user to rinse out the cleansing article without retaining moisture and/or cleansing materials.

20 Claims, 6 Drawing Sheets

CLEANSING RECEPTACLE

FIELD

The invention relates to articles used for cleansing purposes, and in particular, to articles designed for receiving cleansers for such cleansing purposes.

BACKGROUND SECTION

Although solid cleansers are highly popular personal cleansers, they are not without problems. One problem associated with using solid cleansers, such as soap bars, is that the bars become very slippery when wet and easily dropped. Another problem associated with solid cleansers is that they eventually become so small and difficult to handle that many consumers discard the solid cleansers once they become small, resulting in waste. A further problem associated with the use of solid cleansers includes the formation of mushy mass. Such mushy mass often results when wet soap bars have softened, typically after sitting in water for a period of time. Mushy mass typically forms on the bottom of the solid cleanser and is quite undesirable and not of great use. Another problem associated with solid cleansers is their general poor lathering ability.

Certain cleansing implements have been developed to be utilized with solid cleansers or liquid personal washing cleansers and are well known in the art. For example, one well-known cleansing implement includes the sponge generally made of closed cell material, for example, polyurethane foam. However, sponges are generally known to retain moisture and cleansing materials, thereby promoting mold and microbial growth. Another more recent development includes polymer mesh puffs. However, such puffs tend to be rather abrasive and rough on the skin. Further, the puffs are ill-designed for retaining the soaps for any length of period for cleansing.

Yet other recently developed cleansing implements include bag structures used to retain solid cleansers. In use, one or more solid cleansers are dropped into the bag structure, and form a holding receptacle for the solid cleanser(s). In turn, the bag provides a mechanism for the user to grip the solid cleanser while bathing. The bag structure is usually made of at least some open cell material to allow solid cleansing lather to pass through the structure, enabling the user to rub the bag structure across the body for cleansing purposes. However, one problem often encountered with such bag structures is that they don't provide enough surface area to provide for adequate lathering of the solid cleanser. In addition, depending on the specific design of the bag structures, further problems encountered can include the structures being generally rough on the skin and/or being apt to retain moisture and cleansing materials, thereby promoting mold and microbial growth.

Embodiments of the present invention are directed to overcoming, or at least reducing these limitations.

SUMMARY

Embodiments of the invention relate to providing a cleansing article. The cleansing article generally includes one or more of a receptacle, a container, one or more segments, a material piece, and one or more of a solid cleanser and a liquid cleanser. The receptacle, the container, the one or more segments, and the material piece are each generally formed of an open cell material. In certain embodiments, the receptacle is used with the one or more segments to increase the activating area of the receptacle. As such, more soapy lather can be created via the one or more solid cleanser and liquid cleanser in comparison to solely using the receptacle. In certain embodiments, the one or more segments are held within the receptacle via the container or via the material piece. As such, the segments being held in such fashion collectively serve as a temporary reservoir for soapy lather created. However, since the receptacle, the container, the one or more segments, and the material piece are each generally formed of an open cell material, the cleansing article enables a user to rinse out the cleansing article without retaining moisture and/or cleansing materials.

In some embodiments, a cleansing article is provided. The cleansing article comprises a closeable receptacle formed of an open cell material and sized to accommodate one or more items. The cleansing article also comprises a container retaining one or more segments. The container is located within the receptacle thereby increasing an activation area of the receptacle. The container and the one or more segments each formed of at least one open cell material. The open cell material of the receptacle, the container, and the one or more segments is formed of a water permeable material sufficiently permeable to allow water and one or more of liquid cleanser and contents of a solid cleanser which are either dissolved, dispersed, or suspended in the water to pass therethrough.

Additionally, in some embodiments, a cleansing article is provided. The cleansing article comprises a closeable receptacle formed of an open cell material and sized to accommodate one or more items. The cleansing article also comprises one or more segments formed of an open cell material. The one or more segments are located within the receptacle thereby increasing an activation area of the receptacle. The one or more segments are distributed across an inner surface of the receptacle, and at least one of the one or more segments are fixedly coupled to the inner surface of the receptacle to prevent bunching of the one or more segments across the inner surface.

Further, in some embodiments, a method of using a cleansing article while bathing is provided. One step of the method comprises providing a closeable receptacle formed of an open cell material. The receptacle contains one or more segments formed of an open cell material. The one or more segments are located within the receptacle thereby increasing an activation area of the receptacle. The one or more segments are distributed across an inner surface of the receptacle, with at least one of the one or more segments being fixedly coupled to the inner surface of the receptacle to prevent bunching of the one or more segments across the inner surface. Another step of the method comprises wetting the receptacle and the one or more segments. An additional step of the method comprises activating the receptacle and the one or more segments by rubbing one or more of a solid cleanser and a liquid cleanser across a surface area of the receptacle, thereby creating a soapy lather from the one or more solid cleanser and liquid cleanser. A further step of the method comprises rubbing at least one portion of skin of a user with the receptacle, thereby applying the soapy lather to the at least one skin portion. Another step of the method comprises rinsing the receptacle with water, thereby rinsing the receptacle and the one or more segments contained therein with the water. A further step of the method comprises letting the receptacle air dry.

DETAILED DESCRIPTION OF THE PREFERRED EMBODIMENTS

Figure 1:
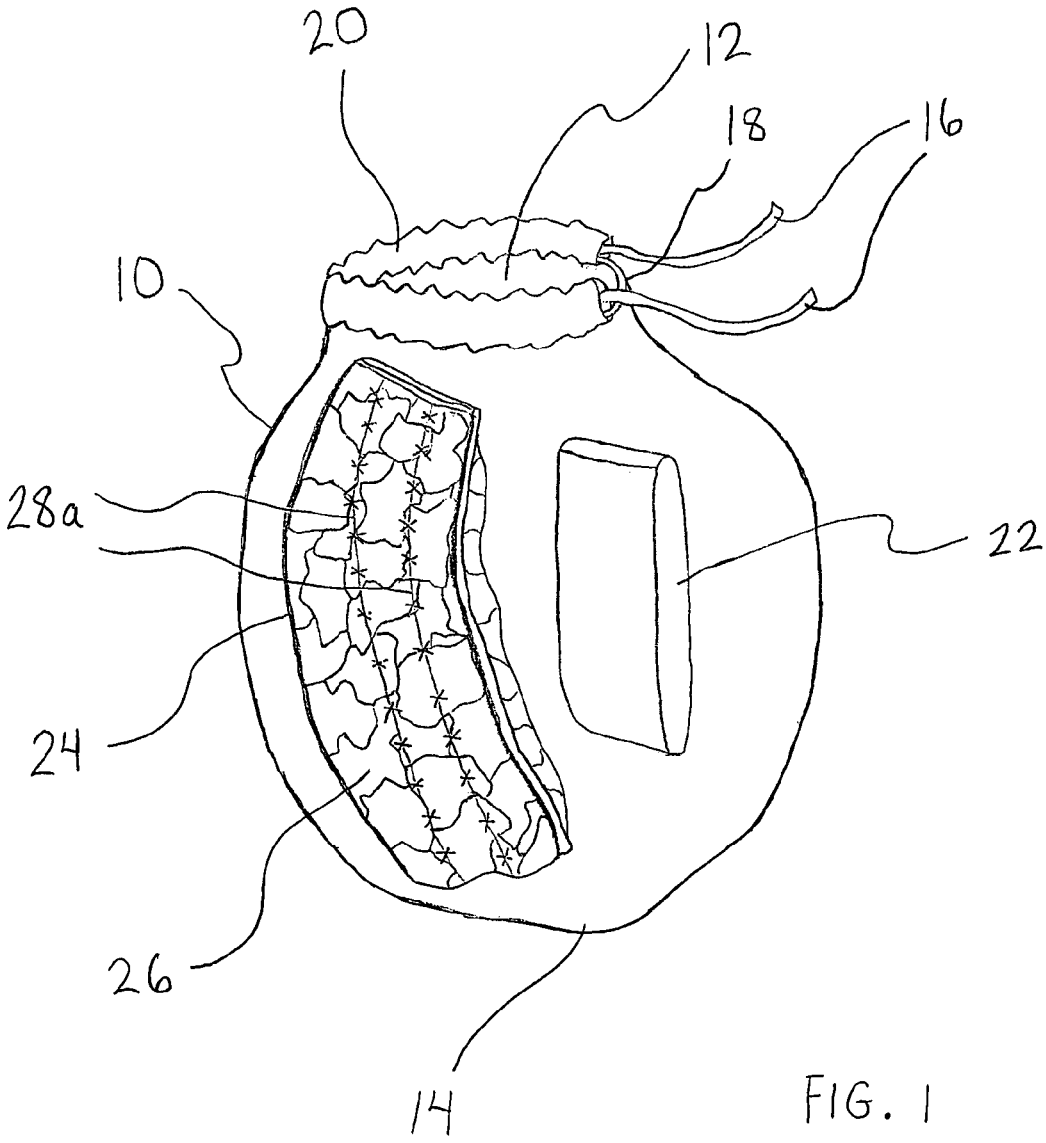
FIG. 1 is a perspective side view of a cleansing article and elements used therewith in accordance with certain embodiments of the invention.

The following discussion is presented to enable a person skilled in the art to make and use the present teachings. Various modifications to the illustrated embodiments will be readily apparent to those skilled in the art, and the generic principles herein may be applied to other embodiments and applications without departing from the present teachings. Thus, the present teachings are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of the present teachings. Skilled artisans will recognize the examples provided herein have many useful alternatives and fall within the scope of the present teachings.

FIG. 1 illustrates a side perspective view of a cleansing article in accordance with certain embodiments of the invention. The cleansing article includes a receptacle 10 generally having an open end 12 and a closed end 14. In certain embodiments, the receptacle 10 forms a pouch for holding one or more items deposited in the receptacle 10 through the open end 12. A tightening mechanism 16 (e.g., a drawstring) is generally looped around the open end 12. As such, upon depositing the one or more items through the open end 12 of the receptacle 10, the tightening mechanism 16 can be tightened, in effect, to close the open end 12. In certain embodiments, the tightening mechanism 16 can be tightened by pulling both ends of the mechanism 16 and subsequently tying the ends together; however, it should be appreciated that other methods of using the mechanism 16 can be used for closing the open end 12. For example, one end of the tightening mechanism 16 may be fixedly attached to an edge 18 defining the receptacle open end 12 (e.g., by being sewn) so that only the other end of the mechanism 16 needs to be pulled tight to close the open end 12. In certain embodiments, as shown, a wrap 20 is fixedly coupled around at least a length of the edge 18 (e.g., via sewing). As such, the tightening mechanism 16 can extend around the length of the edge 18 and is loosely retained thereto by the wrap 20. In certain embodiments, one or more of the ends of the tightening mechanism 16 may have looped ends which can be used to hang the receptacle 10 following use for drying purposes.

Figure 2:
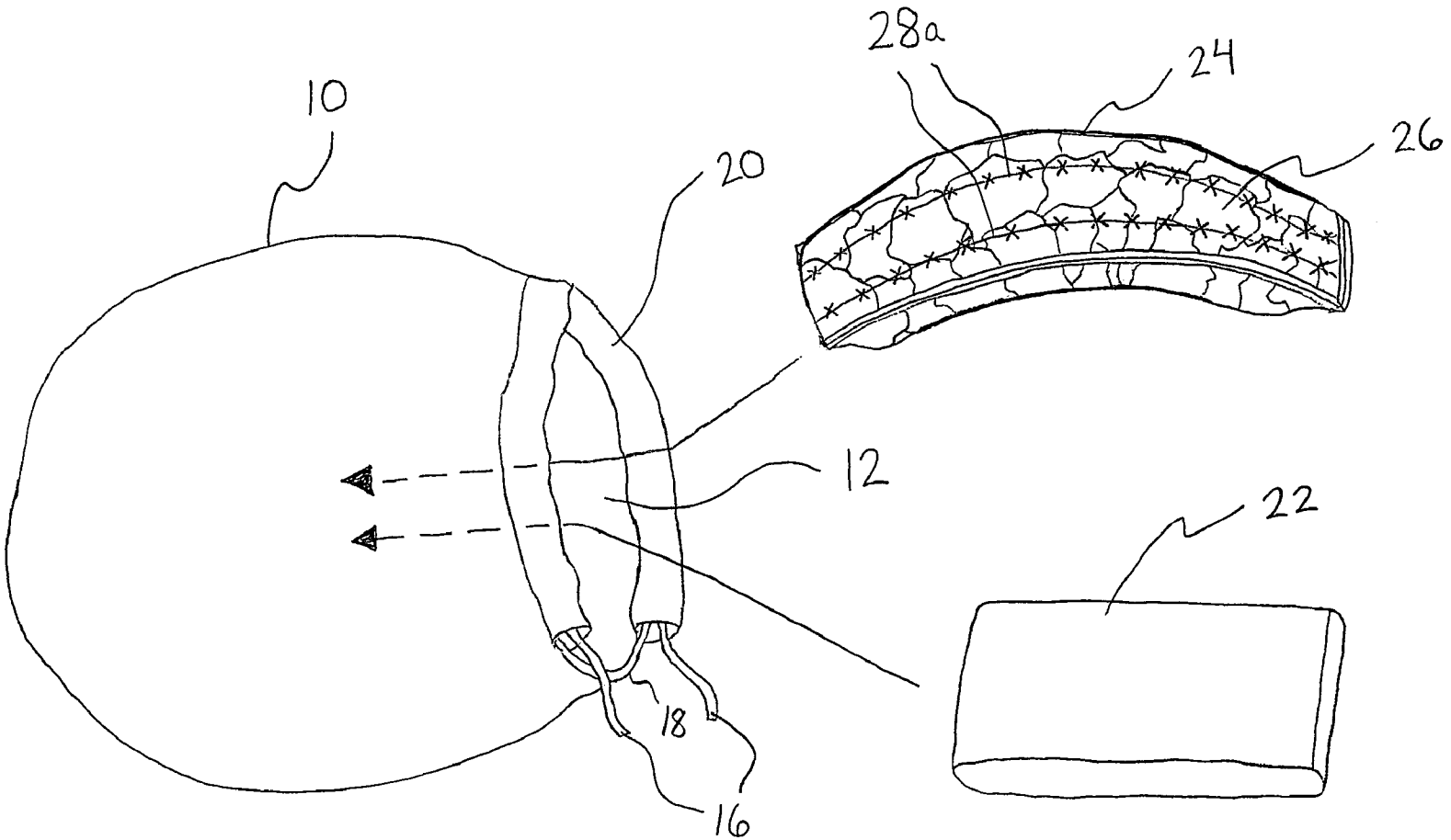
FIG. 2 is an a further perspective side view of the cleansing article and the elements of FIG. 1.

As mentioned above, the cleansing article includes the receptacle 10. As illustrated in FIG. 2, the receptacle 10 can be used to receive one or more solid cleansers 22 (e.g., soap bars) by depositing such through the open end 12 of the receptacle 10. The receptacle 10 is also designed to accommodate a container 24, as shown in FIG. 1. As illustrated in FIG. 2, the receptacle 10 can be used to receive the container 24 by depositing such through the open end 12 of the receptacle 10. The container 24 is generally configured to hold one or more segments 26. In general, the one or more segments 26 are deposited (e.g., randomly) within the container 24, thereby increasing the overall surface area of the container 24. In certain embodiments, to prevent bunching of the one or more segments 26 within one or more inner spaces within the container 24, one or more of the segments 26 are fixedly coupled to a surface of the container 24 (e.g., via sewing). In certain embodiments, as shown in FIGS. 1 and 2, one or more of the segments 26 are fixedly coupled to the container surface via stitching 28*a*.

The receptacle 10, the container 24, and the one or more segments 26 are formed of open cell material. As such, in certain embodiments, the receptacle 10, the container 24, and the segments 26 are formed of any such porous or water permeable material sufficiently permeable to allow water and one or more liquid cleansers (not shown) and contents of the solid cleansers 22 which are either dissolved, dispersed, or suspended in the water to pass therethrough. Preferably, the receptacle 10, the container 24, and the segments 26 are sufficiently water insoluble so that they maintain their integrity over long periods of repeated use. Useful materials include polymeric mesh, woven or nonwoven fabric, paper, tissue, or fabric, etc. In certain embodiments, a light weight polymeric meshed substrate is used. One useful material is an extruded tubular netting mesh, particularly prepared from polyolefins such as polyethylene and the like, and other materials such as polyamides or polyesters and the like. Such materials can be single or multiple ply netting. In certain embodiments, the structure of the permeable material can be polygonal, e.g., diamond shaped, or the like; however, also suitable are irregular shapes. Advantageously, the permeable material of the receptacle 10, the container 24, and the one or more segments 26 have cells of large enough size so as to permit water and lather from solid or liquid cleaners to freely pass therethrough, yet are small enough, with respect to the receptacle 10, to retain the container 24 and the solid cleanser 22 therein, and with respect to the container 24, to retain the segments 26 therein.

As shown in FIG. 1, the receptacle 10 is shown accommodating the solid cleanser 22 and the container 24; however, the invention should not be limited to such. For example, if commercialized, it should be appreciated that the receptacle 10 may be sold separately from one or more of the solid cleanser 22 and the container 24. As such, if a consumer wanted to replace one of either the receptacle 10 or the container 24, for example, the consumer would not have to buy both as a set. Additionally, even though FIGS. 1 and 2 illustrate the receptacle 10 and container 24 being used with the solid cleanser 22, it is to be appreciated that the invention should not be so limited, as described herein.

Figure 3:
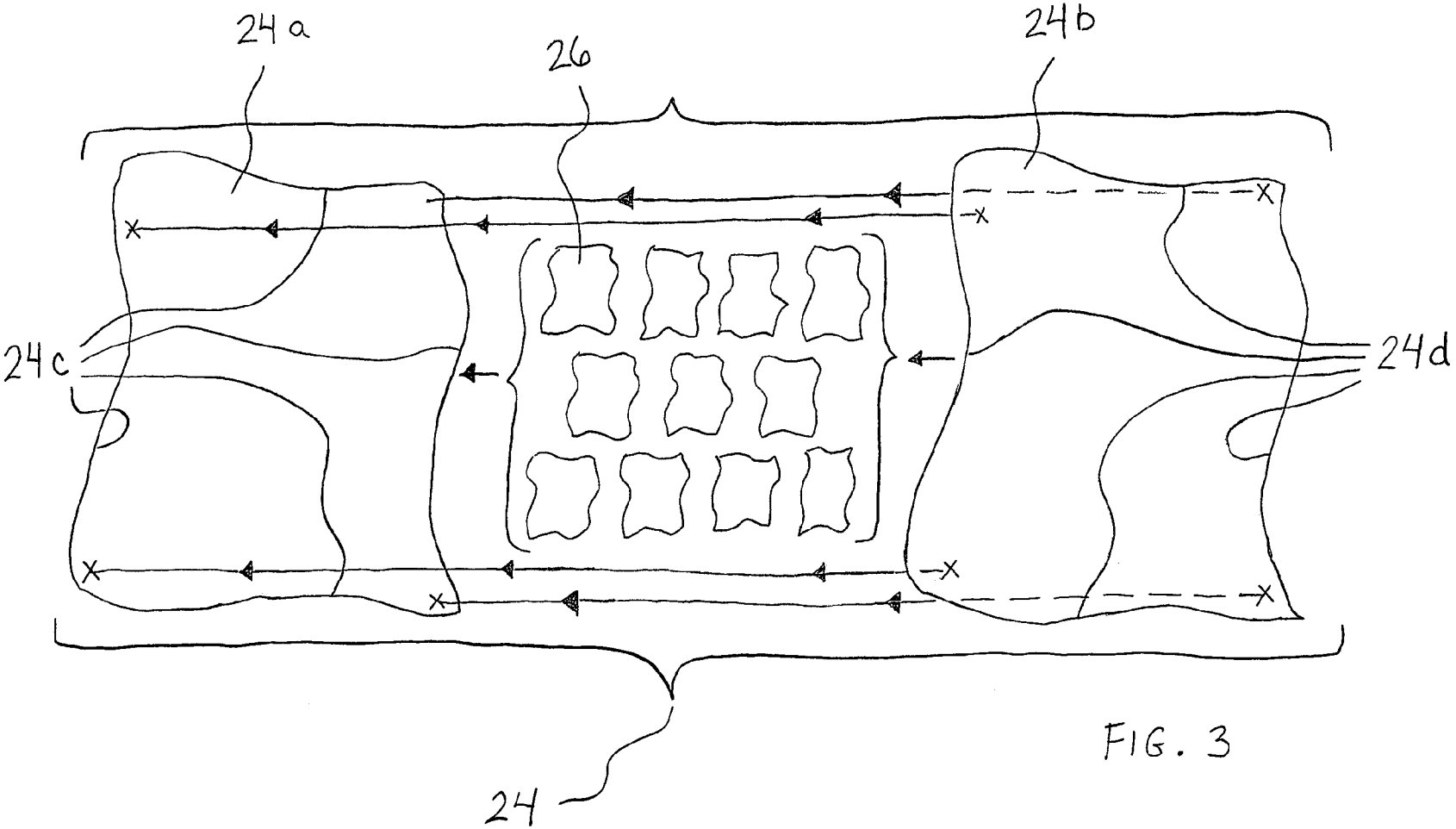
FIG. 3 is an exploded side view of one of the elements of FIG. 1.

FIG. 3 is an exploded side view of the container 24. In certain embodiments, as shown, the container 24 is formed of one or more similarly-shaped material pieces 24*a* and 24*b*, each respectively having outer edges 24*c* and 24*d* that are fixedly coupled together (e.g., by sewing), thereby forming the container 24. The invention, however, should not be limited to such, as it is to be appreciated that the container 24 can just as well be formed of one piece of material or more than two pieces of material fixedly coupled together in a variety of fashions to form the container 24. In addition, even though the pieces 24*a*, 24*b* are shown as somewhat rectangular in shape, it is to be appreciated that the pieces 24*a*, 24*b* can be configured of any desirable shape. Shown between the material pieces 24*a* and 24*b* are the one or more segments 26. While the segments 26 are shown as a certain quantity in FIG. 3, it is not intended to limit the invention to such. Instead, it is to be appreciated that the invention can accommodate segments 26 of greater or lesser quantities and still be within the spirit of the invention. In addition, the segments 26 are each shown to be of comparable size; however, it is to be appreciated that the plurality of segments 26 can include a variety of different sizes and shapes as well. Further, in certain embodiments, the segments 26 held between the one or more container pieces 24*a*, 24*b* may very well be a single sheet of material compressed in size so as to be accommodated within the container 24. As exemplified in FIG. 3, the container piece 24*b* is placed on top of the container piece 24*a* so that the segments 26 are held therebetween. Subsequently, the corresponding edges 24*c*, 24*d* of each side 22*a*, 22*b* respectively are fixedly coupled together (e.g., by sewing) to form the container 22. Alternatively, in certain embodiments, the sides 24*a*, 24*b* may be fixedly coupled together (e.g., by sewing) using areas proximate to the edges 24*c*, 24*d* or by using only certain portions of the edges 24*c*, 24*d*.

While FIGS. 1 and 2 respectively illustrate and suggest that both the solid cleanser 22 and the container 24 can be accommodated by the receptacle 10, it should be appreciated that there are a number of fashions in which the receptacle 10 may be used with either or both of the solid cleanser 22 and the container 24. One method that is known to be used with other bag structures involves depositing the solid cleanser 22 within the receptacle 10 as described above, and subsequently wetting the receptacle 10 and solid cleanser 22. In turn, a user can activate the cleansing article (the receptacle 10) by rubbing an inner surface of the receptacle 10 against the solid cleaner 22 to create a soapy lather. It should be appreciated that this rubbing can be done by hand or with the aid of a wash cloth. Next, the receptacle 10 can be rubbed against the skin to push the soapy lather out of the receptacle 10 and onto the skin; however, with only the receptacle 10 being activated to create the soapy lather, the amount of lather that can be created and subsequently applied is generally limited. As such, this method often involves repeatedly activating the cleansing article as described above to create additional soapy lather after the initially created soapy lather is used. When finished bathing, the user can generally rinse the receptacle 10 and solid cleanser 22 with water to dispose of any soapy lather not used and allow the receptacle 10 and solid cleanser 22 to dry (e.g., by hanging the receptacle 10).

Another method of use involves depositing the container 24 within the receptacle 10 as described above, and subsequently wetting the receptacle 10 and container 24. In turn, a user would activate the cleansing article (the receptacle 10, the container 24 and the segments 26 contained therein) by rubbing solid cleanser 22 and/or depositing and rubbing liquid personal washing cleanser (not shown in the figures) across one or more outer surfaces of the receptacle 10 to create a soapy lather. As is to be appreciated, using the container 24 in combination with the receptacle 10 enables more soapy lather to be created in contrast to only using the receptacle 10 because of the increased surface area that can be activated. Further, the one or more segments 26 in the container 24 not only function in increasing the activating area of the cleansing article (via the surface area of the segments 26), but also collectively serve as a temporary retaining reservoir for the soapy lather. Generally, this is due to the large surface area provided by the segments 26, which in turn, enables the temporary retention of the soapy lather within the container 24. Next, the receptacle 10 can be rubbed against the skin to push the soapy lather out of the receptacle 10 and onto the skin. Because of the increased amount of soapy lather created and the temporary retention of such as described above, it should be appreciated that the receptacle 10 and container 24 combination could be used for longer durations without having to reactivate the same. When finished bathing, the user can generally rinse the receptacle 10 and container 24 with water together or separately to dispose of any lather not used. It should be noted that each of the receptacle 10, the container 24 and the segments 26 contained therein, unlike a sponge of closed cell material, would allow the user to rinse all the soapy lather out. Thus, if rinsed adequately, the receptacle 10, the container 24 and the segments 26 contained therein would not retain moisture and cleansing materials, and thereby not promote mold and microbial growth. Subsequently, if desired, the receptacle 10 and container 24 can be hung to dry, either separately or as one unit.

A further method of use involves depositing both the solid cleanser 22 and the container 24 within the receptacle 10 as described above, and subsequently wetting the receptacle 10, the solid cleanser 22, and the container 24. In turn, a user can activate both the receptacle 10 and the container 24 and the segments 26 contained therein simultaneously by rubbing the solid cleanser 22 against one or more inner surfaces of the receptacle 10 and one or more outer surfaces of the container 24 to create soapy lather. As described in the above method, using the container 24 in combination with the receptacle 10 enables more soapy lather to be created in contrast to only using the receptacle 10 because of the increased surface area that can be activated. In addition, by locating the solid cleanser 22 within the receptacle 10, both the inner surface area of the receptacle 10 and the outer surface area of the container 24 can be activated simultaneously. As such, a user has the potential to create soapy lather more efficiently than if the receptacle 10 and container 24 were activated with the solid cleanser 22 outside the receptacle 10. Also, as described above, the segments 26 in the container 24 function in increasing the activation area of the cleansing article, and collectively serve as a temporary retaining reservoir for the soapy lather. Again, this is due to the large surface area provided by the segments 26, which in turn, enables the temporary retention of the soapy lather within the container 24. Next, the receptacle 10 can be rubbed against the skin to push the soapy lather out of the receptacle 10 and onto the skin. Because of the increased amount of soapy lather created and the temporary retention of such as described above, it should be appreciated that the receptacle 10 and container 24 combination could be used for longer durations without having to reactivate the same. When finished bathing, the user can generally rinse the receptacle 10, the solid cleanser 22, and the container 22 with water together or separately to dispose of any lather not used. Again, as described above, each of the receptacle 10, the container 24 and the segments 26 contained therein, unlike a sponge of closed cell material, would allow the user to rinse all the soapy lather out. Thus, if rinsed adequately, the receptacle 10, the container 24 and the segments 26 contained therein would not retain moisture and cleansing materials, and thereby not promote mold and microbial growth. Subsequently, if desired, the receptacle 10, the container 24, and the solid cleanser 22 can be hung to dry, either separately or as one or more units.

Figure 4:
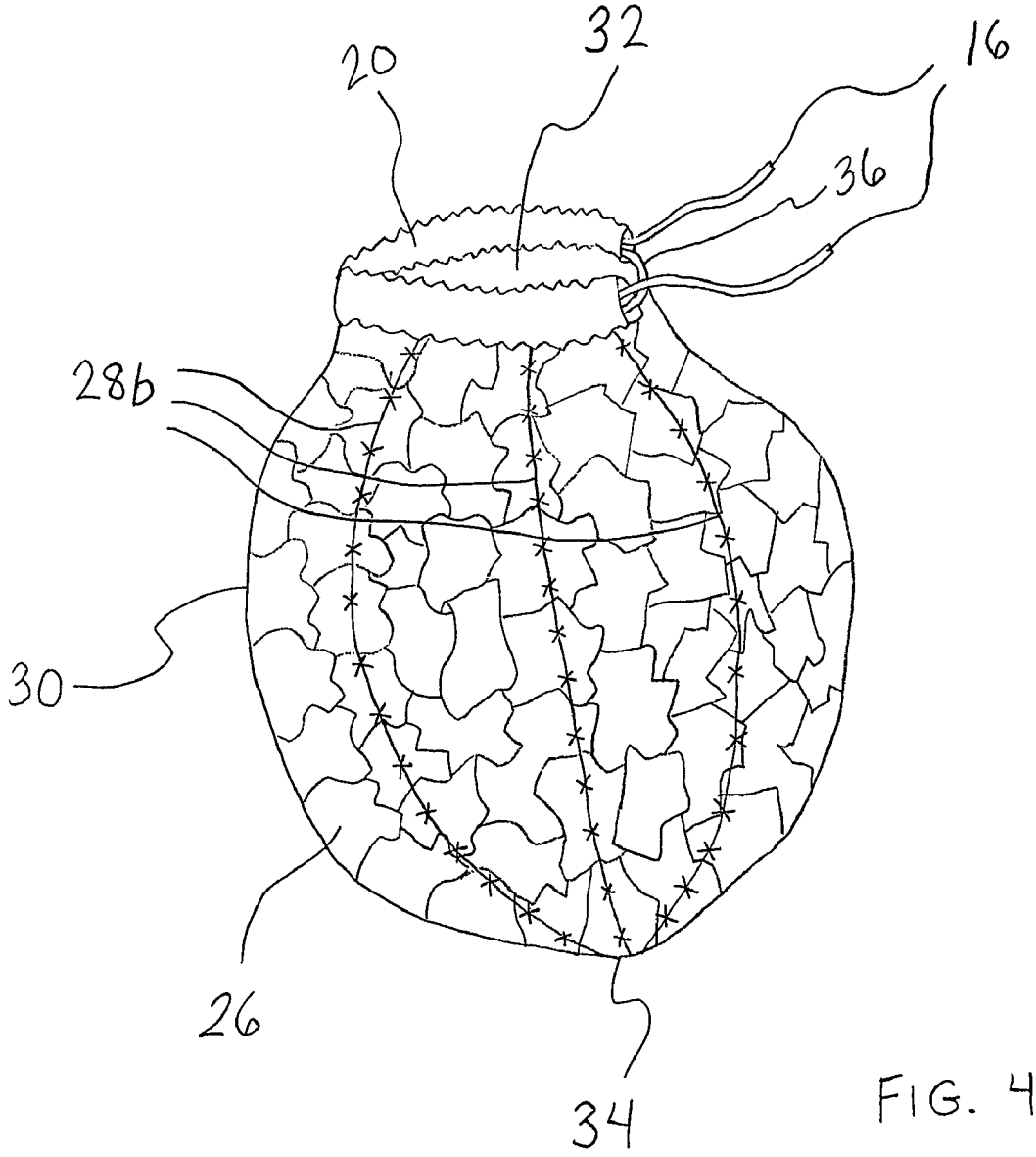
FIG. 4 is a perspective side view of another cleansing article in accordance with certain embodiments of the invention.

FIG. 4 illustrates a side perspective view of a further cleansing article in accordance with certain embodiments of the invention. Like the cleansing article described above, the cleansing article includes a receptacle 30 generally having an open end 32 and a closed end 34. In addition, like the receptacle 10 described above, in certain embodiments, the receptacle 30 forms a pouch for holding one or more items deposited in the receptacle 30 through the open end 32. The receptacle 30 also incorporates the tightening mechanism 16 as already described above. As such, the same description provided above with respect to the tightening mechanism 16 being used with the receptacle 10 similarly applies to the tightening mechanism 16 being used with the receptacle 30. In certain embodiments, as shown, the wrap 20 (as described above) is fixedly coupled around at least a length of an edge 36 defining the receptacle open end 32 (e.g., via sewing). As such, the tightening mechanism 16 can extend around the length of the edge 36 and is loosely retained thereto by the wrap 20.

Figure 5:
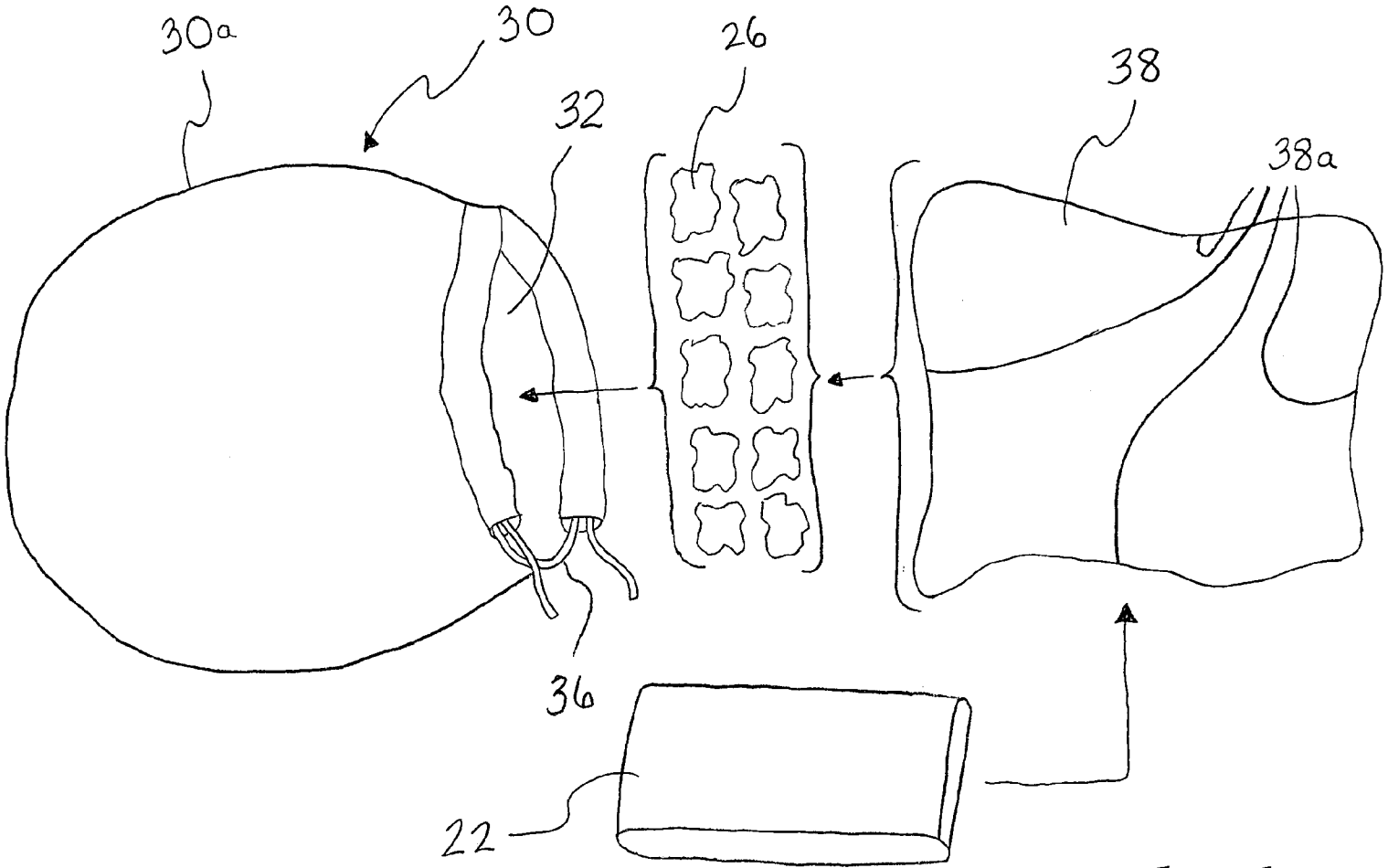
FIG. 5 is an exploded side view of the cleansing article of FIG. 4 and elements used therewith in accordance with certain embodiments of the invention.
Figure 6:
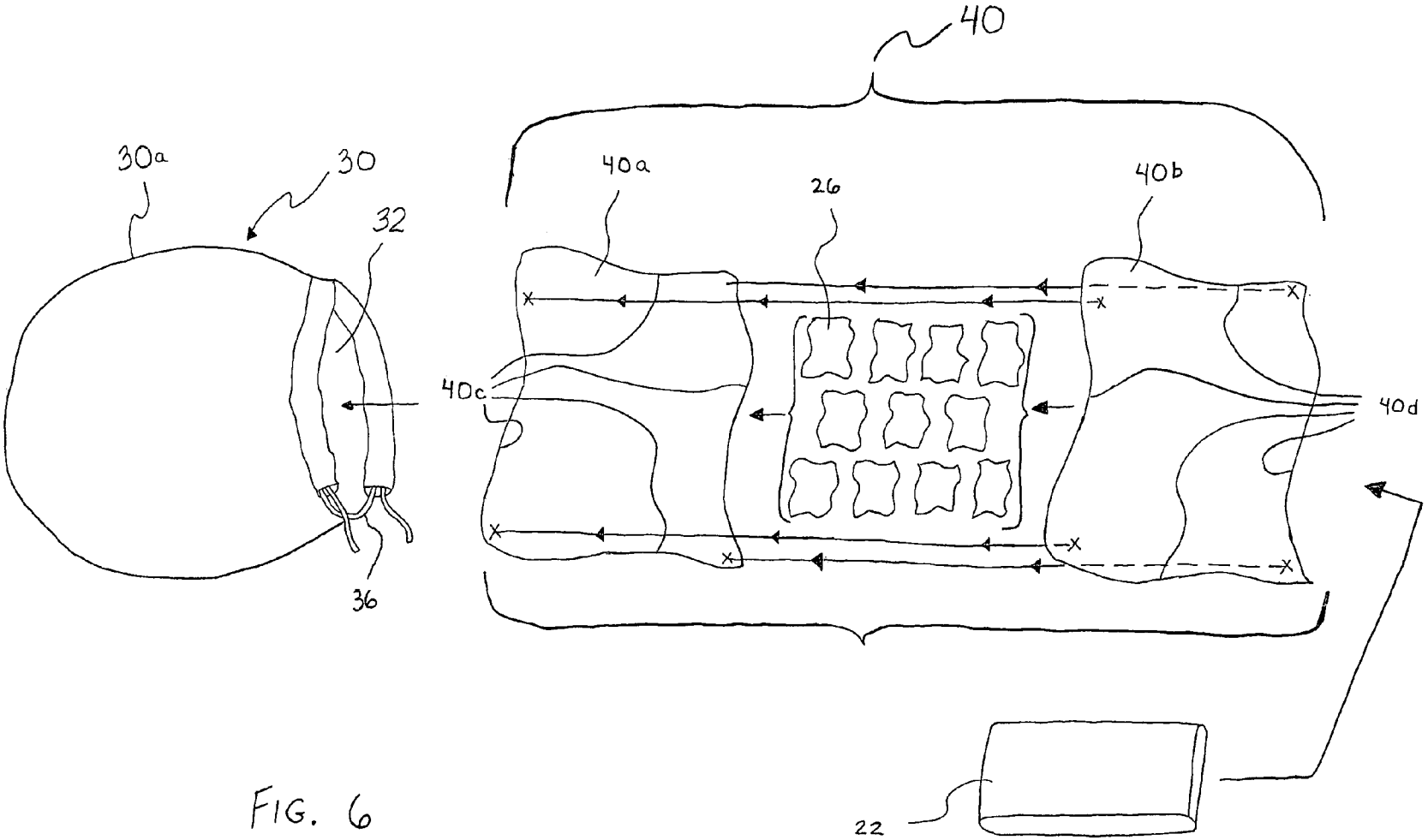
FIG. 6 is a further exploded side view of the cleansing article of FIG. 4 and elements used therewith in accordance with certain embodiments of the invention.

As illustrated in FIGS. 4 through 6, the receptacle 30 is designed to accommodate one or more of the segments 26 already described above. As such, the same description provided above involving the size, shape and quantity of the one or more segments 26 being used with the cleansing article 10 similarly applies to the one or more segments 26 being used with the cleansing article 30. As shown in FIG. 5, in certain embodiments, the receptacle 30 can be used to receive the one or more segments 26 by depositing such through the open end 32 of the receptacle 30. In general, the one or more segments 26 are deposited across an inner surface 30*a* of the receptacle 30, thereby increasing the activation area of the cleansing article. As also shown in FIG. 5, a material piece 38 is inserted in the open end 32 of the receptacle 30 so as to keep the one or more segments 26 between the material piece 38 and the inner surface 30*a* of the receptacle 30. In certain embodiments, the material piece 38 and the inner surface 30*a* are similarly sized. As such, the material piece 38 can generally be oriented to entirely cover the one or more segments 26. In turn, the material piece 38 can be fixedly coupled to the receptacle 30 (e.g., via sewing). In certain embodiments, when the material piece 38 and the inner surface 30*a* of the receptacle 30 are similarly sized, edges 38*a* of the material piece 38 can be fixedly coupled to the edge 36 defining the receptacle open end 32 (e.g., by sewing). As shown in FIG. 4, in certain embodiments, regardless of the size of the material piece 38, the piece 38 can be fixedly coupled to the inner surface 30*a* of the receptacle 30 via stitching 28*b*. In certain embodiments, such stitching 28*b* can be used in combination to achieve the function described above (or separately) to prevent bunching of the one or more segments 26 within one or more spaces across the inner surface of the receptacle 30 by having the stitching 28*b* extend through the one or more segments 26 located in those stitched areas.

As shown in FIG. 6, the receptacle 30 can also be used to receive the one or more segments 26, yet in an alternate fashion. In particular, in contrast to what is described above with respect to FIG. 5, the one or more segments 26 are initially located between two or more material pieces 40*a* and 40*b*. Similar to that described above with respect to FIG. 3 when forming the container 22, the sizes, shapes, and coupling methods of the pieces 40*a* and 40*b* can likewise be applied here. As such, the pieces 40*a*, 40*b* can be fixedly coupled together to form a container 40 for the cleansing article. Once formed, the container 40 is deposited through the open end 32 of the receptacle 30. In general, once deposited within the receptacle 30, the one or more segments 26 and the container 40 collectively increase the activation area of the cleansing article. In contrast to the use of the container 22 in FIGS. 1 through 3 however, the container 40 is fixedly coupled to the inner surface 30*a* of the receptacle 30 (e.g., by sewing). In certain embodiments, the material pieces 40*a*, 40*b* and the inner surface 30*a* are similarly sized. As such, in certain embodiments, edges 40*c* and 40*d* of the material pieces 40*a* and 40*b* respectively of the container 40 can be fixedly coupled to the edge 36 defining the receptacle open end 32 (e.g., by sewing). As shown in FIG. 4, in certain embodiments, regardless of the size of the material pieces 40*a* and 40*b*, the container 40 can be fixedly coupled to the inner surface 30*a* of the receptacle 30 via stitching 28*b*. In certain embodiments, such stitching 28*b* can be used in combination to achieve the function described above (or separately) to prevent bunching of the one or more segments 26 within one or more spaces within the container 40 by having the stitching 28*b* extend through the one or more segments 26 located in those stitched areas.

Similar to the receptacle 10, the container 24, and the one or more segments 26 described above, the receptacle 30, the one or more segments 26, and the material pieces 38, 40*a*, and 40*b* can be formed of any porous or water permeable material sufficiently permeable to allow water and one or more liquid cleansers (not shown) and contents of the solid cleansers 22 which are either dissolved, dispersed, or suspended in the water to pass therethrough. As such, the material description detailed above with respect to the receptacle 10, the container 24, and the one or more segments 26 can be similarly applied with respect to the receptacle 30, the one or more segments 26, and the material pieces 38, 40*a*, and 40*b*.

As referenced above, FIGS. 5 and 6 are exploded side views of the cleansing article. As illustrated in FIGS. 4 through 6 and described above, the one or more segments 26 are deposited in the receptacle 30 across the inner surface 30*a* thereof. With reference to FIG. 5, the one or more segments 26 are subsequently held between the inner surface 30*a* and the material piece 38 and are secured in the receptacle 30 as described above. With reference to FIG. 6, the one or more segments 26 are subsequently held within the container 40 and are secured in the receptacle 30 as described above.

While FIGS. 5 and 6 suggest that the solid cleanser 22 can be accommodated by the receptacle 30, the invention should not be so limited. It should be appreciated that there are a number of fashions in which the receptacle 30 may be used with the solid cleanser 22. With reference to FIG. 5, one method of use can involve wetting the receptacle 30. In turn, a user would activate the cleansing article (the receptacle 30, the segments 26, and the material piece 38) by either rubbing solid cleanser 22 and/or depositing and rubbing liquid personal washing cleanser (not shown in the figures) across one or more outer surfaces of the receptacle 30 to create a soapy lather. In certain embodiments, the solid cleanser 22 is deposited within the receptacle 30 for such activation; however, the method should not be limited as such. By locating the solid cleanser 22 inside the receptacle 30, as mentioned above, the receptacle 30, the segments 26, and the material piece 38 can be activated simultaneously. As such, a user has the potential to create more soapy lather than if the receptacle 30, the segments 26, and the material piece 38 were activated with the solid cleanser 22 outside the receptacle 30. As is to be appreciated, using the one or more segments 26 and the material piece 38 in combination with the receptacle 30 enables more soapy lather to be created in contrast to just using the receptacle 30 alone because of the increased surface area that can be activated. Further, the segments 26 held between the receptacle inner surface 30*a* and the material piece 38 not only function in increasing the activation area of the cleansing article, but also collectively serve as a temporary retaining reservoir for the soapy lather. Generally, this is due to the large surface area provided by the segments 26, which in turn, enables the temporary retention of the soapy lather within the space defined between the receptacle inner surface 30*a* and the material piece 38. Next, the receptacle 30 can be rubbed against the skin to push the soapy lather out of the receptacle 30 and onto the skin. Because of the increased amount of soapy lather created and the temporary retention of such as described above, it should be appreciated that the receptacle 30, the segments 26, and the material piece 38 combination could be used repeatedly without having to reactivate the same. When finished bathing, the user can generally rinse the receptacle 30, the segments 26, and the material piece 38 with water to dispose of any lather not used. It should be noted that each of the receptacle 30, the one or more segments 26 trapped within the space defined by the material piece 38 and the receptacle inner surface 30*a*, and the material piece 38, unlike a sponge of closed cell material, would allow the user to rinse all the soapy lather out. Thus, if rinsed adequately, the receptacle 30, the segments 26, and the material piece 38 would not retain moisture and cleansing materials, and thereby not promote mold and microbial growth. Subsequently, if desired, the cleansing article can be hung to dry.

With respect to FIG. 6, one further method involves wetting the receptacle 30. In turn, a user would activate the cleansing article (the receptacle 30, the segments 26, and the container 40) by either rubbing solid cleanser 22 and/or depositing and rubbing liquid cleanser (not shown in the figures) across one or more outer surfaces of the receptacle 30 to create a soapy lather. In certain embodiments, the solid cleanser 22 is deposited within the receptacle 30 for such activation; however, the method should not be limited as such. As described in the above method, using the container 40 in combination with the receptacle 30 enables more soapy lather to be created in contrast to just using the receptacle 30 alone because of the increased surface area that can be activated. Further, the segments 26 held within the container 40 not only function in increasing the activation area of the cleansing article, but also collectively serve as a temporary retaining reservoir for the soapy lather. Again, this is due to the large surface area provided by the segments 26, which in turn, enables the temporary retention of the soapy lather within the container 40. Next, the receptacle 30 can be rubbed against the skin to push the soapy lather out of the receptacle 30 and onto the skin. Because of the increased amount of soapy lather created and the temporary retention of such as described above, it should be appreciated that the receptacle 30 and the container 40 combination could be used repeatedly without having to reactivate the same. When finished bathing, the user can generally rinse the receptacle 30 along with the container 40 with water to dispose of any lather not used. Again, as described above, each of the receptacle 30, the container 40 and the segments 26 trapped therein, unlike a sponge of closed cell material, would allow the user to rinse all the soapy lather out. Thus, if rinsed adequately, the receptacle 30, the container 40 and the segments 26 contained therein would not retain moisture and cleansing materials, and thereby not promote mold and microbial growth. Subsequently, if desired, the cleansing article can be hung to dry.

It will be appreciated the embodiments of the present invention can take many forms. The true essence and spirit of these embodiments of the invention are defined in the appended claims, and it is not intended the embodiment of the invention presented herein should limit the scope thereof.

What is claimed is:

1. A cleansing article, comprising:

a receptacle formed of an open cell material, the receptacle defining a closable opening through which one or more items may be passed and subsequently retained in the receptacle; and a closed container located within the receptacle and formed of at least two walls, the at least two walls joined at their respective edges so as to prevent the container from being opened, a first wall of the two walls of the container comprising an inner surface of the receptacle, the container retaining one or more segments between the at least two container walls with the one or more segments being distributed throughout the container, the container and the one or more segments each comprising separate bodies and each formed of at least one open cell material, the container and the one or more segments retained therein increasing an activation area of the receptacle.

2. The cleansing article of claim 1, wherein the items comprise one or more of the container and the solid cleanser.

3. The cleansing article of claim 1, wherein at least one of the one or more segments is fixedly coupled to one of the walls of the container to prevent bunching of the one or more segments within the container.

4. The cleansing article of claim 1, wherein the activation area of the receptacle comprises a surface area of the receptacle and surface areas of the container and the one or more segments over which soapy lather can be created from contact with the water and one or more of the liquid cleanser and the solid cleanser.

5. The cleansing article of claim 1, wherein the one or more segments comprise a plurality of segments.

6. The cleansing article of claim 1, wherein the one or more segments are in a compressed state in the container.

7. The cleansing article of claim 6, wherein the one or more segments in a compressed state define a temporary reservoir for soapy lather.

8. The cleansing article of claim 1, wherein the container is free to move within the receptacle.

9. The cleansing article of claim 1, wherein the container is of a size similar to a size of the inner surface of the receptacle.

10. The cleansing article of claim 9, wherein a second wall of the at least two walls comprises a material piece, wherein the material piece is fixedly coupled to one or more of the inner surface of the receptacle and an edge defining an opening of the receptacle.

11. The cleansing article of claim 1, further comprising a solid cleanser located within the receptacle.

12. The cleansing receptacle of claim 1, wherein the first wall of the at least two walls of the container comprises the entire inner surface of the receptacle.

13. A cleansing article, comprising:

a receptacle formed of an open cell material, the receptacle defining a closable opening through which one or more items may be passed and subsequently retained in the receptacle; and a plurality of segments located within the receptacle, the plurality of segments each formed of at least one open cell material and each comprising a separate material body from the receptacle, the plurality of segments being distributed over an inner surface of the receptacle thereby increasing an activation area of the receptacle, more than one of the plurality of segments fixedly coupled to the receptacle inner surface to prevent bunching of the plurality of segments within the receptacle.

14. The cleansing article of claim 13, wherein the plurality of segments are contained within a space defined by the inner surface of the receptacle and a material piece that is located within the receptacle, wherein the material piece is formed of an open cell material, and wherein the material piece is fixedly coupled to one or more of the inner surface of the receptacle and an edge defining an opening of the receptacle.

15. The cleansing article of claim 13, wherein the activation area of the receptacle comprises a surface area of the receptacle and surface areas of the plurality of segments over which soapy lather can be created from contact with water and one or more of a liquid cleanser and a solid cleanser.

16. The cleansing article of claim 13, wherein the open cell material of the receptacle and the plurality of segments is formed of a water permeable material sufficiently permeable to allow water and one or more of liquid cleanser and contents of a solid cleanser which are either dissolved, dispersed, or suspended in the water to pass therethrough.

17. The cleansing article of claim 13, wherein the plurality of segments are in a compressed state in the container.

18. The cleansing article of claim 17, wherein the plurality of segments in a compressed state define a temporary reservoir for soapy lather.

19. A method of making a cleansing article for use while bathing, wherein the cleansing article is made to have an increased activation area, comprising:

providing a receptacle formed of an open cell material, the receptacle defining a closable opening through which one or more items may be passed and subsequently retained in the receptacle; and locating a plurality of segments formed of at least one open cell material within the receptacle the plurality of segments each comprising a separate material body from the receptacle, the plurality of segments uniformly distributed over an inner surface of the receptacle thereby increasing an activation area of the receptacle, one or more of the plurality of segments fixedly coupled to the receptacle inner surface to prevent bunching of the one or more segments within the receptacle.

20. The method of claim 19, wherein the locating step further includes securing the plurality of segments within a space defined by the inner surface of the receptacle and a material piece that is located within the receptacle, wherein the material piece is formed of an open cell material, and wherein the material piece is fixedly coupled to one or more of the inner surface of the receptacle and an edge defining the opening of the receptacle.

* * * * *